US011294296B2

(12) United States Patent
Fumita et al.

(10) Patent No.: US 11,294,296 B2
(45) Date of Patent: Apr. 5, 2022

(54) TONER

(71) Applicant: CANON KABUSHIKI KAISHA, Tokyo (JP)

(72) Inventors: Hidekazu Fumita, Gotemba (JP); Noriyoshi Umeda, Suntou-gun (JP); Tomonori Matsunaga, Suntou-gun (JP); Satoshi Otsuji, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 48 days.

(21) Appl. No.: 16/911,556

(22) Filed: Jun. 25, 2020

(65) Prior Publication Data

US 2021/0003934 A1 Jan. 7, 2021

(30) Foreign Application Priority Data

Jul. 2, 2019 (JP) ..... JP2019-123922

(51) Int. Cl.
*G03G 9/097* (2006.01)
*G03G 9/08* (2006.01)
*G03G 9/087* (2006.01)

(52) U.S. Cl.
CPC ..... *G03G 9/09791* (2013.01); *G03G 9/0819* (2013.01); *G03G 9/08711* (2013.01); *G03G 9/09708* (2013.01); *G03G 9/09725* (2013.01)

(58) Field of Classification Search
CPC .. G03G 9/0825; G03G 9/097; G03G 9/09708; G03G 9/09725; G03G 9/0975; G03G 9/09791
See application file for complete search history.

(56) References Cited

U.S. PATENT DOCUMENTS

| | | | |
|---|---|---|---|
| 6,627,374 | B2 | 9/2003 | Fumita et al. |
| 6,835,521 | B2 | 12/2004 | Tsuji et al. |
| 6,951,704 | B2 | 10/2005 | Tsuji et al. |
| 7,135,263 | B2 | 11/2006 | Kawakami et al. |
| 7,611,813 | B2 | 11/2009 | Ida et al. |
| 7,611,816 | B2 | 11/2009 | Tuji et al. |
| 7,767,370 | B2 | 8/2010 | Ishigami et al. |
| 7,906,262 | B2 | 3/2011 | Ishigami et al. |
| 8,114,562 | B2 | 2/2012 | Ishigami et al. |
| 8,545,133 | B2 | 10/2013 | Fumita et al. |
| 8,916,319 | B2 | 12/2014 | Ikeda et al. |
| 8,940,467 | B2 | 1/2015 | Hashimoto et al. |
| 9,261,806 | B2 | 2/2016 | Moribe et al. |
| 9,285,697 | B2 | 3/2016 | Fukudome et al. |
| 9,366,981 | B2 | 6/2016 | Yamawaki et al. |
| 9,459,547 | B2 | 10/2016 | Terasaki |
| 9,785,068 | B2 | 10/2017 | Umeda et al. |
| 10,054,866 | B2 | 8/2018 | Tanaka et al. |
| 10,635,011 | B2 | 4/2020 | Umeda et al. |
| 10,678,155 | B2 | 6/2020 | Terui et al. |
| 10,747,133 | B2 | 8/2020 | Yagi et al. |
| 2010/0248126 | A1 | 9/2010 | Ishigami et al. |
| 2011/0053073 | A1* | 3/2011 | Isono ..... G03G 9/0827 430/108.3 |
| 2011/0097661 | A1 | 4/2011 | Ishigami et al. |
| 2012/0094225 | A1 | 4/2012 | Ishigami et al. |
| 2015/0003875 | A1 | 1/2015 | Ishigami et al. |
| 2018/0246430 | A1* | 8/2018 | Tanaka ..... G03G 9/09725 |
| 2019/0041763 | A1* | 2/2019 | Tsuda ..... G03G 9/08795 |
| 2020/0124999 | A1 | 4/2020 | Tanaka et al. |
| 2020/0142329 | A1 | 5/2020 | Yamawaki et al. |
| 2020/0209766 | A1 | 7/2020 | Yamawaki et al. |
| 2020/0292955 | A1 | 9/2020 | Matsunaga et al. |

FOREIGN PATENT DOCUMENTS

| | | | |
|---|---|---|---|
| JP | H10-090941 | * 10/1998 | ..... G03G 9/083 |
| JP | 2010-079242 | 4/2010 | |
| JP | 2015-141360 | 8/2015 | |

OTHER PUBLICATIONS

Translation of H10-090941.*

* cited by examiner

*Primary Examiner* — Peter L Vajda
(74) *Attorney, Agent, or Firm* — Venable LLP

(57) ABSTRACT

A toner comprising: a toner particle including a binder resin; and an external additive, wherein the external additive includes an external additive A which is silica fine particles and an external additive B which is a fatty acid metal salt, the external additive A has a specific particle diameter, a coverage ratio of a surface of the toner particle with the external additive A is from 60% to 80%, and where an average theoretical surface area obtained from a number average particle diameter, a particle size distribution and a true density of the toner particle is denoted by C ($m^2/g$), an amount of the external additive B is denoted by D (parts by mass) and a coverage ratio of the surface of the toner particle with the external additive B is denoted by E (%), following formulas are satisfied:

$$0.05 \leq D/C \leq 2.00$$

$$E/(D/C) \leq 50.0.$$

7 Claims, No Drawings

TONER

BACKGROUND OF THE INVENTION

Field of the Invention

The present invention relates to a toner for developing an electrostatic charge image (electrostatic latent image) that is to be used in an image forming method such as electrophotography and electrostatic printing.

Description of the Related Art

In recent years, copiers and printers have been required to have higher speed and higher image quality stability. Regarding toners, there is a further demand for high durability capable of withstanding the increase in speed, and for improved performance for stabilizing image quality in a long life.

As a technique for improving toner durability, Japanese Patent Application Publication 2015-141360 discloses a toner in which a thermosetting resin is included in an encapsulating material having a capsule film hardness of 1 N/m or more and less than 3 N/m. The idea is that such toner can withstand a strong shear.

Meanwhile, as a method for stabilizing the image quality in a long life, it is necessary to stably remove the toner remaining after the transfer on the surface of the electrophotographic photosensitive member with a cleaning blade. For example, it is known that where a fatty acid metal salt is included in the toner, the fatty acid metal salt functions as a lubricant in a cleaning nip portion and a cleaning property can be stabilized. Meanwhile, it is also known that filming occurs on the electrostatic latent image bearing member.

Japanese Patent Application Publication 2010-079242 discloses a toner capable of stably improving filming by using a fatty acid metal salt having a specific particle diameter and particle size distribution.

SUMMARY OF THE INVENTION

However, in recent years, it has become clear that image deterioration such as fogging occurs due to toner deterioration even when the technique disclosed in Japanese Patent Application Publication 2015-141360 is used.

It has likewise become clear that where the technique disclosed in Japanese Patent Application Publication 2010-079242 is used under recent speed-up conditions, retransfer occurs as a new problem. Retransfer is a phenomenon in which the toner transferred (primarily transferred) from a photosensitive member to an intermediate transfer member in an upstream image forming unit is transferred to a photosensitive member in a downstream image forming unit. This will lead to image defects such as a decrease in image density.

The present invention provides a toner that is more durable than conventional toners, can provide stable cleaning properties by using a fatty acid metal salt, and can prevent retransfer even though the fatty acid metal salt is used.

A toner comprising:

a toner particle including a binder resin; and an external additive, wherein the external additive includes an external additive A and an external additive B, the external additive A is silica fine particles, the external additive B is a fatty acid metal salt, the external additive A has a number average particle diameter of primary particles of from 5 nm to 25 nm, a coverage ratio of a surface of the toner particle with the external additive A is from 60% to 80%, and where an average theoretical surface area obtained from a number average particle diameter, a particle size distribution and a true density of the toner particle measured by a Coulter counter is denoted by C ($m^2/g$), an amount of the external additive B with respect to 100 parts by mass of the toner particle is denoted by D (parts by mass) and a coverage ratio of the surface of the toner particle with the external additive B is denoted by E (%), following formulas (1) and (2) are satisfied:

$$0.05 \leq D/C \leq 2.00 \quad (1)$$

$$E/(D/C) \leq 50.0 \quad (2).$$

The present invention can provide a toner that is more durable than conventional toners, can provide stable cleaning properties by using a fatty acid metal salt, and can prevent retransfer even though the fatty acid metal salt is used.

Further features of the present invention will become apparent from the following description of exemplary embodiments.

DESCRIPTION OF THE EMBODIMENTS

Unless otherwise specified, descriptions of numerical ranges such as "from XX to YY" or "XX to YY" in the present invention include the numbers at the upper and lower limits of the range.

The present invention provides a toner including:

a toner particle including a binder resin; and an external additive, wherein the external additive includes an external additive A and an external additive B, the external additive A is silica fine particles, the external additive B is a fatty acid metal salt, the external additive A has a number average particle diameter of primary particles of from 5 nm to 25 nm, a coverage ratio of a surface of the toner particle with the external additive A is from 60% to 80%, and where an average theoretical surface area obtained from a number average particle diameter, a particle size distribution and a true density of the toner particle measured by a Coulter counter is denoted by C ($m^2/g$), an amount of the external additive B with respect to 100 parts by mass of the toner particles is denoted by D (parts by mass) and a coverage ratio of the surface of the toner particle with the external additive B is denoted by E (%), following formulas (1) and (2) are satisfied:

$$0.05 \leq D/C \leq 2.00 \quad (1)$$

$$E/(D/C) \leq 50.0 \quad (2).$$

Depending on process conditions, conventional toners including a fatty acid metal salt sometimes cannot withstand the increase in a developing roller rotation speed and developer stirring speed caused by the increase in printer speed. The reason therefor is considered hereinbelow.

In addition to a fatty acid metal salt, conventional toners usually include an external additive such as silica particles. The fatty acid metal salt is an easily deformable spreadable material, and when a shear force is applied thereto, the fatty acid metal salt spreads on the toner particle surface. At that time, the fatty acid metal salt captures silica. That is, since silica is likely to be detached from the toner particle surface, the charging becomes non-uniform, which causes image defects such as fogging.

It has also been found that conventional toners including a fatty acid metal salt tend to cause the retransfer due to increase in a printer speed. The reason therefor is considered hereinbelow.

In the case of a negative-charging toner, it is conceivable that when the toner transferred (primarily transferred) to the intermediate transfer member in the image forming unit on the upstream side passes through a potential section of a non-image section of the photosensitive member in the image forming unit on the downstream side, discharge is generated and the toner polarity is reversed from negative to positive, thereby transferring the toner onto the photosensitive member.

As mentioned hereinabove, with the conventional toner using a fatty acid metal salt, when the developing roller rotation speed and the developer stirring speed are increased, an external additive such as silica may be easily separated, and there are segments where negative charging is insufficient. It is conceivable that where a discharge takes place when the potential portion of the non-image section of the photosensitive member is passed, the polarity is strongly reversed to become more positive, so that the retransfer is more likely to occur.

By simultaneously improving both the presence state of silica in which silica is less likely be captured by the fatty acid metal salt and the presence state of the fatty acid metal salt in which silica is less likely to be separated, it is possible to prevent the occurrence of retransfer due to a decrease in charging performance.

It is necessary that the coverage ratio of silica fine particles, which constitute the external additive A, on the surface of the toner particle be from 60% to 80%.

Within this range, it is possible to create a state in which the silica fine particles are close to each other and the interaction by the Van der Waals forces creates a state in which the silica fine particles are unlikely to separate from the toner particle surface.

A method of controlling mixing conditions of silica can be used to keep the coverage ratio within the above range.

Where the coverage ratio is less than 60%, the silica fine particles are separated from each other, the interaction due to the Van der Waals forces does not act sufficiently, and the separation of silica from the toner particle surface cannot be sufficiently prevented. Where the coverage ratio is more than 80%, the separation is unlikely to occur, but fixing performance is deteriorated.

The coverage ratio is preferably from 65% to 75%.

The number average particle diameter of primary particles of the external additive A needs to be from 5 nm to 25 nm. Where the number average particle diameter is less than 5 nm, the Van der Waals forces are too strong, and electrostatic agglomeration of silica fine particles occurs, which facilitates the separation from the toner particle surface.

Meanwhile, where the number average particle diameter is larger than 25 nm, the Van der Waals forces between the toner particle surface and the silica fine particles are reduced, and the silica fine particles are likely to separate.

The number average particle diameter is preferably from 5 nm to 16 nm.

Where an average theoretical surface area obtained from a number average particle diameter, a particle size distribution and a true density of the toner particle measured by a Coulter counter is denoted by C ($m^2/g$), an amount of the external additive B with respect to 100 parts by mass of the toner particle is denoted by D (parts by mass) and a coverage ratio of the surface of the toner particle with the external additive B is denoted by E (%), the following formulas (1) and (2) are satisfied:

$$0.05 \leq D/C \leq 2.00 \quad (1)$$

$$E/(D/C) \leq 50.0 \quad (2).$$

D/C is an expression making it possible to ascertain the degree to which a toner particle is covered by the external additive B when the toner particle is spherical, and E/(D/C) is an expression representing the actual degree of coverage with respect to the theoretical coverage ratio.

D/C needs to be from 0.05 to 2.00. Where D/C is less than 0.05, sufficient amount of the fatty acid metal salt is not supplied, and a cleaning property cannot be improved. Meanwhile, where D/C exceeds 2.00, retransfer occurs due to poor charging caused by deterioration of toner flowability. The D/C is more preferably from 0.05 to 0.80.

It is important that E/(D/C) be 50.0 or less. E/(D/C) being 50.0 or less indicates that the actual coverage ratio is lower than the theoretically calculated coverage ratio and means that the fatty acid metal salt is adhered or fixed in the form of particles to the toner particle surface without being spread thereon.

Where E/(D/C) exceeds 50.0, the fatty acid metal salt is present in a spread state on the toner particle surface due to external addition. In that case, the fatty acid metal salt easily captures and separates the silica fine particles, and the retransfer occurs.

E/(D/C) is preferably 35.0 or less, more preferably 25.0 or less. Meanwhile, the lower limit is not particularly limited, but is preferably 5.0 or more, more preferably 10.0 or more. E/(D/C) can be controlled by the particle diameter and particle size distribution of toner particles, the type and amount of external additives, and the mixing conditions of external additives.

The average theoretical surface area C ($m^2/g$) is preferably from 0.6 to 1.5, and more preferably from 0.9 to 1.1.

The amount D of the external additive B is preferably from 0.03 parts by mass to 3.0 parts by mass, and more preferably from 0.05 parts by mass to 1.0 part by mass with respect to 100 parts by mass of the toner particles. The coverage ratio E (%) is preferably from 0.3 to 30.0, and more preferably from 0.5 to 20.0.

The fixation ratio G of the fatty acid metal salt, which constitutes the external additive B, to the toner particle is preferably 10.0% or less. When the fixation ratio is 10.0% or less, a state is exhibited in which the fatty acid metal salt is not spread by mixing with the toner particles and is unlikely to be fixed to the toner particles, and the separation of silica fine particles can be prevented.

The fixation ratio G is more preferably 5.0% or less. The lower limit is not particularly limited, but is preferably 0% or more. The fixation ratio G can be controlled by the type and addition amount of the fatty acid metal salt, and the mixing conditions (temperature, rotation time, etc.) of the fatty acid metal salt.

The external additive B is described hereinbelow. The external additive B is a fatty acid metal salt.

The fatty acid metal salt is preferably a salt of at least one metal selected from the group consisting of zinc, calcium, magnesium, aluminum, and lithium. Further, a fatty acid zinc salt or a fatty acid calcium salt is more preferable, and a fatty acid zinc salt is even more preferable. When these are used, the effect of the present invention becomes more prominent.

As the fatty acid of the fatty acid metal salt, a higher fatty acid having from 8 to 28 carbon atoms (more preferably, from 12 to 22 carbon atoms) is preferable. The metal is preferably a divalent or higher polyvalent metal. That is, the external additive B is preferably a fatty acid metal salt of a divalent or higher (more preferably divalent or trivalent, more preferably divalent) polyvalent metal and a fatty acid having from 8 to 28 (more preferably from 12 to 22) carbon atoms.

When a fatty acid having 8 or more carbon atoms is used, generation of free fatty acid is easily suppressed. The free fatty acid amount is preferably 0.20% by mass or less. Where the fatty acid has 28 or fewer carbon atoms, the melting point of the fatty acid metal salt does not become too high, and the fixing performance is unlikely to be inhibited. Stearic acid is particularly preferred as the fatty acid. The divalent or higher polyvalent metal preferably includes zinc.

Examples of fatty acid metal salts include metal stearates such as zinc stearate, calcium stearate, magnesium stearate, aluminum stearate, lithium stearate, and the like, and zinc laurate.

The fatty acid metal salt preferably includes at least one selected from the group consisting of zinc stearate and calcium stearate.

The volume-based median diameter D50s of the fatty acid metal salt is preferably from 0.15 μm to 2.00 μm, and more preferably from 0.40 μm to 1.30 μm.

When the volume-based median diameter is 0.15 μm or more, the particle diameter is appropriate, so that the function as a lubricant is improved and the cleaning property is improved. Further, when the particle diameter is 2.00 μm or less, the fatty acid metal salt is less likely to accumulate between a developing roller and a regulation blade, and development streaks can be prevented.

The fatty acid metal salt preferably has a span value B defined by the following formula (3) of 1.75 or less.

$$\text{Span value } B=(D95s-D5s)/D50s \quad (3)$$

wherein D5s is a volume-based 5% cumulative diameter of the fatty acid metal salt, D50s is a volume-based 50% cumulative diameter of the fatty acid metal salt, and D95s is a volume-based 95% cumulative diameter of the fatty acid metal salt. The span value B is an index indicating the particle size distribution of the fatty acid metal salt. Where the span value B is 1.75 or less, the spread of the particle diameter of the fatty acid metal salt present in the toner becomes small, so that a better charge stability can be obtained. Therefore, the amount of toner charged to the opposite polarity is reduced, and the fogging and retransfer can be suppressed. The span value B is more preferably 1.50 or less because a more stable image is obtained. A more preferable value is 1.35 or less. The lower limit is not particularly limited, but is preferably 0.50 or more, and more preferably 0.80 or more.

The external additive preferably includes a hydrotalcite compound.

By including a hydrotalcite compound, silica detachment can be further prevented, and retransfer and fogging can be prevented.

The present inventors consider the reason as follows. In the case of a negative-charging toner, the hydrotalcite compound often has a positive polarity as compared with the toner particle and the silica fine particles, and the hydrotalcite compound exerts an attachment force on both the toner particles and the silica fine particles. Therefore, the silica fine particles are unlikely to separate from the toner particle because the hydrotalcite compound is interposed therebetween.

In addition, it is considered that the hydrotalcite compound acts as a microcarrier and imparts the toner with charging performance, thereby compensating poor charging caused by the separation of the silica fine particles by the fatty acid metal salt, and thus making it possible to prevent the retransfer.

The amount of the hydrotalcite compound is preferably from 0.1 part by mass to 2.0 parts by mass with respect to 100 parts by mass of the toner particles.

The fixation ratio F of the external additive A to the toner particle is preferably 80.0% or more. Within this range, it is possible to prevent the fatty acid metal salt from spreading on the toner particle surface in external addition and from capturing the external additive A at that time.

The fixation ratio F is more preferably 85.0% or more. Meanwhile, the upper limit is not particularly limited, but is preferably 95.0% or less. The fixation ratio F can be controlled by the mixing process conditions (temperature, rotation time, etc.) and the type of the external additive A (particle diameter etc.).

The relationship between the fixation ratio F (%) of the external additive A to the toner particle and the fixation ratio G (%) of the external additive B to the toner particle is preferably $F/G \geq 8.0$. Within this range, the fatty acid metal salt is not spread and is unlikely to be fixed to the toner particle, and the detachment of the silica fine particles can be prevented, so that the retransfer can be further prevented.

More preferably, F/G is 30.0 or higher. The upper limit is not particularly limited, but it is more preferably 150.0 or less.

The external additive A is formed of silica fine particles, and may be those obtained by a dry method, such as fumed silica, or those obtained by a wet method such as a sol-gel method. From the viewpoint of charging performance, it is preferable to use silica fine particles obtained by a dry method.

Furthermore, the external additive A may be surface-treated for the purpose of imparting hydrophobicity and flowability. The hydrophobic method can be exemplified by a method for chemically treating with an organosilicon compound which reacts or physically adsorbs with silica fine particles. In a preferred method, silica produced by vapor phase oxidation of a silicon halide is treated with an organosilicon compound. Examples of such organosilicon compound are listed hereinbelow.

Hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, and benzyldimethylchlorosilane.

Other examples include bromomethyldimethylchlorosilane, α-chloroethyltrichlorosilane, β-chloroethyltrichlorosilane, chloromethyldimethylchlorosilane, triorganosilylmercaptan, trimethylsilylmercaptan, and triorganosilyl acrylate.

Further, other examples include vinyldimethylacetoxysilane, dimethylethoxysilane, dimethyldimethoxysilane, diphenyldiethoxysilane, and 1-hexamethyldisiloxane.

Other examples include 1,3-divinyltetramethyldisiloxane, 1,3-diphenyltetramethyldisiloxane, and dimethylpolysiloxanes having from 2 to 12 siloxane units per molecule and having one hydroxyl group per each Si in the terminal unit. These are used alone or as a mixture of two or more.

In the silica treated with silicone oil, a preferred silicone oil has a viscosity at 25° C. of from 30 $mm^2/s$ to 1000 $mm^2/s$.

Examples include dimethyl silicone oil, methylphenyl silicone oil, α-methylstyrene-modified silicone oil, chlorophenyl silicone oil, and fluorine-modified silicone oil.

The following methods can be used for silicone oil treatment.

A method in which silica treated with a silane coupling agent and silicone oil are directly mixed using a mixer such as a Henschel mixer.

A method for spraying silicone oil on silica as a base. Alternatively, a method for dissolving or dispersing a silicone oil in an appropriate solvent, then adding silica, mixing and removing the solvent.

The silica treated with silicone oil is more preferably heated to a temperature of 200° C. or more (more preferably 250° C. or more) in an inert gas after the treatment with the silicone oil to stabilize the surface coat.

A preferred silane coupling agent is hexamethyldisilazane (HMDS).

To improve the performance of the toner, the toner may further include other external additives.

A preferable production method for adding the external additives A and B is explained hereinbelow.

From the viewpoint of controlling the coverage ratio and fixation ratio of the external additives, it is preferable to divide the step of adding the external additives A and B into two stages. That is, it is preferable to have a step of adding the external additive A to the toner particle and a step of adding the external additive B to the toner particle to which the external additive A has been added.

The steps of adding the external additives A and B to the toner particle may be a dry method, a wet method, or a two-stage method.

The external addition device may be heated in the step of adding the external additive A to the toner particle. The temperature is preferably Tg (the glass transition temperature of the toner particle) or less and is, for example, about 20° C. to 50° C.

From the viewpoint of storage stability, the glass transition temperature Tg of the toner particle is preferably from 40° C. to 70° C., and more preferably from 50° C. to 65° C.

As a device to be used in the external addition step, a device having a mixing function and a function of giving a mechanical impact force is preferable, and a known mixing processing devices can be used. Examples thereof include FM mixer (manufactured by Nippon Coke Industry Co., Ltd.), SUPER MIXER (manufactured by Kawata Co., Ltd.), and HYBRIDIZER (manufactured by Nara Machinery Co., Ltd.).

Next, the external additive B is added to the toner particle to which the external additive A has been added. The same device as that used in the external addition step of the external additive A can be used at this time.

The temperature of the step of adding the external additive B may be, for example, about from 20° C. to 40° C.

When using a hydrotalcite compound, it is preferable to add the hydrotalcite compound at the same time as the external additive B is added.

The amount of the external additive A is preferably from 0.5 parts by mass to 5.0 parts by mass, and more preferably from 1.0 parts by mass to 3.0 parts by mass with respect to 100 parts by mass of the toner particles.

The method for manufacturing the toner particle is explained. The toner particle manufacturing method is not particularly limited, and a known method may be used, such as a kneading pulverization method or wet manufacturing method. A wet method is preferred for obtaining a uniform particle diameter and controlling the particle shape. Examples of wet manufacturing methods include suspension polymerization methods dissolution suspension methods, emulsion polymerization aggregation methods, emulsion aggregation methods and the like, and an emulsion aggregation method may be used by preference.

In emulsion aggregation methods, a fine particle of a binder resin and a fine particle of another material such as a colorant as necessary are dispersed and mixed in an aqueous medium containing a dispersion stabilizer. A surfactant may also be added to this aqueous medium. A flocculant is then added to aggregate the mixture until the desired toner particle size is reached, and the resin fine particles are also melt adhered together either after or during aggregation. Shape control with heat may also be performed as necessary in this method to form a toner particle.

The fine particle of the binder resin here may be a composite particle formed as a multilayer particle comprising two or more layers composed of different resins. For example, this can be manufactured by an emulsion polymerization method, mini-emulsion polymerization method, phase inversion emulsion method or the like, or by a combination of multiple manufacturing methods.

When the toner particle contains an internal additive, the internal additive may be included in the resin fine particle. A liquid dispersion of an internal additive fine particle consisting only of the internal additive may also be prepared separately, and the internal additive fine particle may then be aggregated together with the resin fine particle when aggregating. Resin fine particles with different compositions may also be added at different times during aggregation, and aggregated to prepare a toner particle composed of layers with different compositions.

The following may be used as the dispersion stabilizer:

inorganic dispersion stabilizers such as tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina.

Other examples include organic dispersion stabilizers such as polyvinyl alcohol, gelatin, methyl cellulose, methyl hydroxypropyl cellulose, ethyl cellulose, carboxymethyl cellulose sodium salt, and starch.

A known cationic surfactant, anionic surfactant or nonionic surfactant may be used as the surfactant.

Specific examples of cationic surfactants include dodecyl ammonium bromide, dodecyl trimethylammonium bromide, dodecylpyridinium chloride, dodecylpyridinium bromide, hexadecyltrimethyl ammonium bromide and the like.

Specific examples of nonionic surfactants include dodecylpolyoxyethylene ether, hexadecylpolyoxyethylene ether, nonylphenylpolyoxyethylene ether, lauryl polyoxyethylene ether, sorbitan monooleate polyoxyethylene ether, styrylphenyl polyoxyethylene ether, monodecanoyl sucrose and the like.

Specific examples of anionic surfactants include aliphatic soaps such as sodium stearate and sodium laurate, and sodium lauryl sulfate, sodium dodecylbenzene sulfonate, sodium polyoxyethylene (2) lauryl ether sulfate and the like.

The binder resin constituting the toner is explained next.

Preferred examples of the binder resin include vinyl resins, polyester resins and the like. Examples of vinyl resins, polyester resins and other binder resins include the following resins and polymers.

Monopolymers of styrenes and substituted styrenes, such as polystyrene and polyvinyl toluene; styrene copolymers such as styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer and styrene-maleic acid ester copolymer; and polymethyl methacryalte, polybutyl methacrylate, polvinyl acetate, polyethylene, polypropylene, polvinyl butyral, silicone resin, polyamide resin, epoxy resin, polyacrylic resin, rosin, modified rosin, terpene resin, phenol resin, aliphatic or alicyclic hydrocarbon resins and aromatic petroleum resins.

These binder resins may be used individually or mixed together.

Examples of the polymerizable monomers that can be used in the production of vinyl resins include styrene monomers such as styrene, α-methylstyrene, and the like; acrylic esters such as methyl acrylate, butyl acrylate, and the like; methacrylic acid esters such as methyl methacrylate, 2-hydroxyethyl acrylate, t-butyl methacrylate, 2-ethylhexyl methacrylate, and the like; unsaturated carboxylic acids such as acrylic acid, methacrylic acid, and the like; unsaturated dicarboxylic acids such as maleic acid and the like; unsaturated dicarboxylic anhydrides such as maleic anhydride and the like; nitrile vinyl monomers such as acrylonitrile and the like; halogen-containing vinyl monomers such as vinyl chloride and the like; and nitro vinyl monomers such as nitrostyrene and the like.

The binder resin preferably contains carboxyl groups, and is preferably a resin manufactured using a polymerizable monomer containing a carboxyl group.

The polymerizable monomer containing a carboxyl group includes, for example, vinylic carboxylic acids such as acrylic acid, methacrylic acid, α-ethylacrylic acid and crotonic acid; unsaturated dicarboxylic acids such as fumaric acid, maleic acid, citraconic acid and itaconic acid; and unsaturated dicarboxylic acid monoester derivatives such as monoacryloyloxyethyl succinate ester, monomethacryloyloxyethyl succinate ester, monoacryloyloxyethyl phthalate ester and monomethacryloyloxyethyl phthalate ester.

Polycondensates of the carboxylic acid components and alcohol components listed below may be used as the polyester resin. Examples of carboxylic acid components include terephthalic acid, isophthalic acid, phthalic acid, fumaric acid, maleic acid, cyclohexanedicarboxylic acid and trimellitic acid. Examples of alcohol components include bisphenol A, hydrogenated bisphenols, bisphenol A ethylene oxide adduct, bisphenol A propylene oxide adduct, glycerin, trimethyloyl propane and pentaerythritol.

The polyester resin may also be a polyester resin containing a urea group. Preferably the terminal and other carboxyl groups of the polyester resins are not capped.

To control the molecular weight of the binder resin constituting the toner particle, a crosslinking agent may also be added during polymerization of the polymerizable monomers.

Examples include ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinyl benzene, bis (4-acryloxypolyethoxyphenyl) propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400 and #600, dipropylene glycol diacrylate, polypropylene glycol diacrylate, polyester diacrylate (MANDA, Nippon Kayaku Co., Ltd.), and these with methacrylate substituted for the acrylate.

The added amount of the crosslinking agent is preferably from 0.001 mass parts to 15.000 mass parts per 100 mass parts of the polymerizable monomers.

The toner particle preferably includes a release agent. It is preferable that the toner particle include an ester wax having a melting point of from 60° C. to 90° C. Such a wax is excellent in compatibility with the binder resin, so that a plastic effect can be easily obtained.

Examples of ester waxes include waxes consisting primarily of fatty acid esters, such as carnauba wax and montanic acid ester wax; fatty acid esters in which the acid component has been partially or fully deacidified, such as deacidified carnauba wax; hydroxyl group-containing methyl ester compounds obtained by hydrogenation or the like of plant oils and fats; saturated fatty acid monoesters such as stearyl stearate and behenyl behenate; diesterified products of saturated aliphatic dicarboxylic acids and saturated fatty alcohols, such as dibehenyl sebacate, distearyl dodecanedioate and distearyl octadecanedioate; and diesterified products of saturated aliphatic diols and saturated aliphatic monocarboxylic acids, such as nonanediol dibehenate and dodecanediol distearate.

Of these waxes, it is desirable to include a bifunctional ester wax (diester) having two ester bonds in the molecular structure.

A bifunctional ester wax is an ester compound of a dihydric alcohol and an aliphatic monocarboxylic acid, or an ester compound of a divalent carboxylic acid and a fatty monoalcohol.

Specific examples of the aliphatic monocarboxylic acid include myristic acid, palmitic acid, stearic acid, arachidic acid, behenic acid, lignoceric acid, cerotic acid, montanic acid, melissic acid, oleic acid, vaccenic acid, linoleic acid and linolenic acid.

Specific examples of the fatty monoalcohol include myristyl alcohol, cetanol, stearyl alcohol, arachidyl alcohol, behenyl alcohol, tetracosanol, hexacosanol, octacosanol and triacontanol.

Specific examples of the divalent carboxylic acid include butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), dodecanedioic acid, tridecaendioic acid, tetradecanedioic acid, hexadecanedioic acid, octadecanedioic acid, eicosanedioic acid, phthalic acid, isophthalic acid, terephthalic acid and the like.

Specific examples of the dihydric alcohol include ethylene glycol, propylene glycol, 1,3-propanediol, 1,4-butanediol, 1,5-pentanediol, 1,6-hexanediol, 1,10-decanediol, 1,12-dodecanediol, 1,14-tetradecanediol, 1,16-hexadecanediol, 1,18-octadecanediol, 1,20-eicosanediol, 1,30-triacontanediol, diethylene glycol, dipropylene glycol, 2,2,4-trimethyl-1,3-pentanediol, neopentyl glycol, 1,4-cyclohexane dimethanol, spiroglycol, 1,4-phenylene glycol, bisphenol A, hydrogenated bisphenol A and the like.

Other release agents that can be used include petroleum waxes and their derivatives, such as paraffin wax, microcrystalline wax and petrolatum, montanic wax and its derivatives, hydrocarbon waxes obtained by the Fischer-Tropsch method, and their derivatives, polyolefin waxes such as polyethylene and polypropylene, and their derivatives, natural waxes such as carnauba wax and candelilla wax, and their derivatives, higher fatty alcohols, and fatty acids such as stearic acid and palmitic acid.

The content of the release agent is preferably from 5.0 mass parts to 20.0 mass parts per 100.0 mass parts of the binder resin.

A colorant may also be included in the toner. The colorant is not specifically limited, and the following known colorants may be used.

Examples of yellow pigments include yellow iron oxide, Naples yellow, naphthol yellow S, Hansa yellow G, Hansa yellow 10G, benzidine yellow G, benzidine yellow GR, quinoline yellow lake, permanent yellow NCG, condensed azo compounds such as tartrazine lake, isoindolinone compounds, anthraquinone compounds, azo metal complexes, methine compounds and allylamide compounds. Specific examples include:

C.I. pigment yellow 12, 13, 14, 15, 17, 62, 74, 83, 93, 94, 95, 109, 110, 111, 128, 129, 147, 155, 168 and 180.

Examples of red pigments include red iron oxide, permanent red 4R, lithol red, pyrazolone red, watching red calcium salt, lake red C, lake red D, brilliant carmine 6B, brilliant carmine 3B, eosin lake, rhodamine lake B, condensed azo compounds such as alizarin lake, diketopyrrolopyrrole compounds, anthraquinone compounds, quinacridone compounds, basic dye lake compounds, naphthol compounds, benzimidazolone compounds, thioindigo compound and perylene compounds. Specific examples include:

C.I. pigment red 2, 3, 5, 6, 7, 23, 48:2, 48:3, 48:4, 57:1, 81:1, 122, 144, 146, 166, 169, 177, 184, 185, 202, 206, 220, 221 and 254.

Examples of blue pigments include alkali blue lake, Victoria blue lake, phthalocyanine blue, metal-free phthalocyanine blue, phthalocyanine blue partial chloride, fast sky blue, copper phthalocyanine compounds such as indathrene blue BG and derivatives thereof, anthraquinone compounds and basic dye lake compounds. Specific examples include:

C.I. pigment blue 1, 7, 15, 15:1, 15:2, 15:3, 15:4, 60, 62 and 66.

Examples of black pigments include carbon black and aniline black. These colorants may be used individually, or as a mixture, or in a solid solution.

The content of the colorant is preferably from 3.0 mass parts to 15.0 mass parts per 100.0 mass parts of the binder resin.

The toner particle may also contain a charge control agent. A known charge control agent may be used. A charge control agent that provides a rapid charging speed and can stably maintain a uniform charge quantity is especially desirable.

Examples of charge control agents for controlling the negative charge properties of the toner particle include:

organic metal compounds and chelate compounds, including monoazo metal compounds, acetylacetone metal compounds, aromatic oxycarboxylic acids, aromatic dicarboxylic acids, and metal compounds of oxycarboxylic acids and dicarboxylic acids. Other examples include aromatic oxycarboxylic acids, aromatic mono- and polycarboxylic acids and their metal salts, anhydrides and esters, and phenol derivatives such as bisphenols and the like.

Further examples include urea derivatives, metal-containing salicylic acid compounds, metal-containing naphthoic acid compounds, boron compounds, quaternary ammonium salts and calixarenes.

Meanwhile, examples of charge control agents for controlling the positive charge properties of the toner particle include nigrosin and nigrosin modified with fatty acid metal salts; guanidine compounds; imidazole compounds; quaternary ammonium salts such as tributylbenzylammonium-1-hydroxy-4-naphthosulfonate salt and tetrabutylammonium tetrafluoroborate, onium salts such as phosphonium salts that are analogs of these, and lake pigments of these; triphenylmethane dyes and lake pigments thereof (using phosphotungstic acid, phosphomolybdic acid, phosphotungstenmolybdic acid, tannic acid, lauric acid, gallic acid, ferricyanic acid or a ferrocyan compound or the like as the laking agent); metal salts of higher fatty acids; and resin charge control agents.

One of these charge control agents alone or a combination of two or more may be used. The added amount of these charge control agents is preferably from 0.01 mass parts to 10.00 mass parts per 100.00 mass parts of the polymerizable monomers.

Methods for measuring various physical properties are described hereinbelow. Measurement of Median Diameter and Span Value of External Additive B (fatty acid metal salt)

The volume-based median diameter of the fatty acid metal salt is measured in accordance with MS Z 8825-1 (2001), and is specifically as follows.

As a measuring device, a laser diffraction/scattering type particle size distribution measuring device "LA-920" (manufactured by Horiba, Ltd.) is used. Setting of measurement conditions and analysis of measurement data are performed using dedicated software "HORIBA LA-920 for Windows® WET (LA-920) Ver. 2.02" provided with LA-920. In addition, ion-exchanged water from which impurity solids and the like have been removed in advance is used as the measurement solvent.

The measurement procedure is as follows.

(1) A batch-type cell holder is attached to LA-920.

(2) A predetermined amount of ion-exchanged water is put into a batch-type cell, and the batch-type cell is set in the batch-type cell holder.

(3) The inside of the batch type cell is stirred using a dedicated stirrer tip.

(4) The "REFRACTIVE INDEX" button on the "DISPLAY CONDITION SETTING" screen is pushed and the file "110A000I" (relative refractive index 1.10) is selected.

(5) On the "DISPLAY CONDITION SETTING" screen, the particle diameter is set to be on the volume basis.

(6) After performing the warm-up operation for 1 h or more, adjustment of optical axes, fine adjustment of optical axes, and blank measurement are performed.

(7) About 60 ml of ion-exchanged water is put into a glass 100-ml flat-bottom beaker.

As a dispersing agent, about 0.3 ml of a diluted solution prepared by about three-fold mass dilution of "CONTAMINON N" (a 10% by mass aqueous solution of a neutral detergent for cleaning precision measuring instruments; has a pH of 7 and includes a nonionic surfactant, an anionic surfactant and an organic builder, manufactured by Wako Pure Chemical Industries, Ltd.) with ion-exchanged water is added.

(8) An ultrasonic disperser "Ultrasonic Dispersion System Tetora 150" (manufactured by Nikkaki Bios Inc.) which has an electric output of 120 W and in which two oscillators having an oscillation frequency of 50 kHz are incorporated with a phase difference of 180 degrees is prepared. About 3.3 L of ion-exchanged water is put into the water tank of the ultrasonic disperser, and about 2 ml of CONTAMINON N is added to the water tank.

(9) The beaker of (7) is set in the beaker fixing hole of the ultrasonic disperser, and the ultrasonic disperser is operated. Then, the height position of the beaker is adjusted so that the resonance state of the liquid surface of the aqueous solution in the beaker is maximized.

(10) While irradiating the aqueous solution in the beaker of (9) with ultrasonic waves, about 1 mg of the fatty acid metal salt is added little by little to the aqueous solution in the beaker and dispersed. Then, the ultrasonic dispersion processing is continued for another 60 sec. In this case, the fatty acid metal salt sometimes floats as a lump on the liquid surface. In this case, the lump is submerged in water by rocking a beaker, and then ultrasonic dispersion is performed for 60 sec. In the ultrasonic dispersion, the water temperature of the water tank is adjusted, as appropriate, to be from 10° C. to 40° C.

(11) The aqueous solution which has been prepared in (10) and in which the fatty acid metal salt has been dispersed is immediately added little by little to the batch type cell while taking care not to introduce air bubbles, and the transmittance of the tungsten lamp is adjusted to be from 90% to 95%. Then, the particle size distribution is measured. Based on the obtained volume-based particle size distribution data, a 5% integrated diameter, a 50% integrated diameter, and a 95% integrated diameter from the small particle diameter side are calculated.

The obtained values are denoted by D5s, D50s, and D95s, and the span value is determined from these values.

Method for Measuring True Density of Toner Particles

When measuring the true density, number average particle diameter and so on of toner particle in a toner in which an external additive is externally added to the toner particles, the external additive is removed. The specific method is described hereinbelow.

A total of 160 g of sucrose (manufactured by Kishida Chemical) is added to 100 mL of ion-exchanged water, and dissolved in a water bath to prepare a concentrated sucrose solution. A total of 31 g of the concentrated sucrose solution and 6 mL of CONTAMINON N are placed in a tube for centrifugation to prepare a dispersion liquid. A total of 1 g of the toner is added to the dispersion liquid, and the lumps of the toner are loosened with a spatula or the like.

The tube for centrifugation is shaken for 20 min on a shaker ("KM Shaker" manufactured by Iwaki Sangyo Co., Ltd.) at a condition of 350 strokes per min. After shaking, the solution is transferred to a glass tube (50 mL) for a swing rotor, and centrifuged under conditions of 3500 rpm and 30 min in a centrifuge (H-9R; manufactured by Kokusan Co., Ltd.). In the glass tube after the centrifugation, toner particles are present in the uppermost layer and an external additive is present in the lower layer on the aqueous solution side, so that only the toner particles in the uppermost layer are collected.

Where the external additives have not been sufficiently removed, centrifugation is repeated as necessary, and after sufficient separation, the toner liquid is dried to collect toner particles.

The true density of the toner particles is measured by a dry automatic densitometer—auto pycnometer (manufactured by Yuasa Ionics Co., Ltd.). The conditions are as follows.

Cell: SM cell (10 ml)

Sample amount: about 2.0 g

With this measurement method, the true density of solids and liquids is measured based on a gas phase replacement method. Similar to the liquid phase replacement method, it is based on Archimedes' principle, but since gas (argon gas) is used as the replacement medium, the precision for micropores is high.

Method for Measuring Weight Average Particle Diameter (D4) and Number Average Particle Diameter (D1) of Toner Particles A "Multisizer (R) 3 Coulter Counter (product name)" precise particle size distribution analyzer (Beckman Coulter, Inc.) based on the pore electrical resistance method and a dedicated "Beckman Coulter Multisizer 3 Version 3.51 (product name)" software (Beckman Coulter, Inc.) are used. An aperture tube having diameter of 100 μm is used, and measurement is performed with 25000 effective measurement channels, and analyzing measurement data and calculating.

The aqueous electrolytic solution used in measurement may be a solution of special grade sodium chloride dissolved in ion-exchanged water to a concentration of about 1 mass %, such as "ISOTON II (product name)" (Beckman Coulter, Inc.) for example.

The following settings are performed on the dedicated software prior to measurement and analysis.

On the "Change standard measurement method (SOM)" screen of the dedicated software, the total count number in control mode is set to 50000 particles, the number of measurements to 1, and the Kd value to a value obtained with "Standard particles 10.0 μm" (Beckman Coulter, Inc.). The threshold noise level is set automatically by pushing the "Threshold/noise level measurement" button. The current is set to 1600 μA, the gain to 2, and the electrolyte solution to ISOTON II (product name), and a check is entered for "Aperture tube flush after measurement".

On the "Conversion settings from pulse to particle diameter" screen of the dedicated software, the bin interval is set to the logarithmic particle diameter, the particle diameter bins to 256, and the particle diameter range to 2 μm to 60 μm.

The specific measurement methods are as follows.

(1) About 200 ml of the aqueous electrolytic solution is added to a dedicated glass 250 ml round-bottomed beaker of the Multisizer 3, the beaker is set on the sample stand, and stirring is performed with a stirrer rod counter-clockwise at a rate of 24 rps. Contamination and bubbles in the aperture tube are then removed by the "Aperture flush" function of the dedicated software.

(2) 30 ml of the same aqueous electrolytic solution is placed in a glass 100 ml flat-bottomed beaker, and about 0.3 ml of a dilution of "Contaminon N (product name)" (a 10% by mass aqueous solution of a neutral detergent for washing precision instruments, manufactured by Wako Pure Chemical Industries, Ltd.) diluted 3-fold by mass with ion-exchange water is added.

(3) The prescribed amount of ion-exchange water is added to the water tank of an ultrasonic disperser "Ultrasonic Dispersion System Tetra150 (product name)" (Nikkaki Bios Co., Ltd.) is prepared with an electrical output of 120 W equipped with two built-in oscillators having an oscillating frequency of 50 kHz with their phases shifted by 180° from each other, and about 2 ml of Contaminon N (product name) is added to the tank.

(4) The beaker of (2) above is set in the beaker-fixing hole of the ultrasonic disperser, and the ultrasonic disperser is operated. The height position of the beaker is adjusted so as to maximize the resonant condition of the liquid surface of the aqueous electrolytic solution in the beaker.

(5) The aqueous electrolytic solution in the beaker of (4) above is exposed to ultrasound as about 10 mg of toner particle is added bit by bit to the aqueous electrolytic solution, and dispersed. Ultrasound dispersion is then continued for a further 60 seconds, During ultrasound dispersion, the water temperature in the tank is adjusted appropriately to from 10° C. to 40° C.

(6) The aqueous electrolytic solution of (5) above with the toner particle dispersed therein is dripped with a pipette into the round-bottomed beaker of (1) above set on the sample stand, and adjusted to a measurement concentration of about 5%. Measurement is then performed until the number of measured particles reaches 50000.

(7) The measurement data is analyzed with the dedicated software included with the apparatus, and the weight-average particle diameter (D4) and Number Average Particle Diameter (D1) are calculated. The weight-average particle diameter (D4) is the "Average diameter" on the "Analysis/volume statistical value (arithmetic mean)" screen when graph/volume % is set in the dedicated software. The Number Average Particle Diameter (D1) is the "Average diameter" on the "Analysis/number statistic value (arithmetic mean)" screen when graph/number % is set in the dedicated software.

Method for Calculating Average Theoretical Surface Area C Per Unit Mass of Toner Particle After obtaining the number average particle diameter (D1), the dedicated software "Beckman Coulter Multisizer 3 Version 3.51" (manufactured by Beckman Coulter, Inc.) provided for measurement data analysis is used to divide a range of from 2.0 to 32.0 μm into 12 channels (2.000 to 2.520 μm, 2.520 to 3.175 μm, 3.175 to 4.000 μm, 4.000 to 5.040 μm, 5.040 to 6.350 μm, 6.350 to 8.000 μm, 8.000 to 10.079 μm, 10.079 to 12.699 μm, 12.699 to 16.000 μm, 16.000 to 20.159 μm, 20.159 to 25.398 μm, and 25.398 to 32.000 μm), and the number ratio of toner particles in each particle diameter range is determined.

Thereafter, using the median value of each channel (for example, where the channel is from 2.000 to 2.520 μm, the median value is 2.260 μm), the theoretical surface area (=4×π×(median value of each channel)) is obtained under an assumption that the toner particle with the median value of each channel is a true sphere. This theoretical surface area is multiplied by the previously determined number ratio of particles belonging to each channel to determine the average theoretical surface area (a) of one toner particle under an assumption that the measured toner particle is a true sphere.

Next, the theoretical mass (=⅔×π×(median value of each channel)$^3$×true density) is obtained in the same manner under an assumption that the toner particle with the median value of each channel is a true sphere from the median value of each channel and the measured true density of the toner particles. The average theoretical mass (b) of one toner particle is determined from the theoretical mass and the number ratio of the particles belonging to each channel which has been determined above.

From the above, the average theoretical surface area C ($m^2/g$) per unit mass of the measured toner particle is calculated from the average theoretical surface area and average theoretical mass of one toner particle.

Method for Measuring Coverage Ratio E of External Additive B (Fatty Acid Metal Salt)

The coverage ratio of the fatty acid metal salt is measured by ESCA (X-ray photoelectron spectroscopy) (Quantum 2000 manufactured by ULVAC-PHI).

A 75 mm square platen (provided with a screw hole of about 1 mm diameter for fixing the sample) attached to the device is used as the sample holder. Since the screw hole of the platen is a through hole, the hole is closed with a resin or the like, and a concave portion for measuring powder having a depth of about 0.5 mm is prepared. A measurement sample (toner or external additive B (fatty acid metal salt) alone) is packed into the concave portion with a spatula or the like, and a sample is prepared by grinding.

ESCA measurement conditions are as follows.

Analysis method: narrow analysis

X-ray source: Al-Kα

X-ray conditions: 100μ, 25 W, 15 kV

Photoelectron capture angle: 45°

Pass Energy: 58.70 eV

Measuring range: ϕ100 μm

First, the toner is measured. To calculate the quantitative value of metal atoms contained in the fatty acid metal salt, C is (B. E. 280 eV to 295 eV), 0 is (B. E. 525 eV to 540 eV), Si 2p (B. E. 95 eV to 113 eV) and the element peak of the metal atom of the fatty acid metal salt are used. The quantitative value of the metal element obtained here is denoted by X1.

Next, in the same manner, the elemental analysis of the fatty acid metal salt alone is performed, and the quantitative value of the element contained in the fatty acid metal salt obtained here is denoted by X2.

The coverage ratio is obtained from the following formula by using the X1 and X2.

$$\text{Coverage ratio } E\ (\%) \text{ of fatty acid metal salt} = X1/X2 \times 100$$

Measurement of Amount D of External Additive B

The amount of the external additive B is measured by using a wavelength dispersive X-ray fluorescence analyzer "Axios" (manufactured by PANalytical) and dedicated software "SuperQ ver. 4.0F" (manufactured by PANalytical) that is provided therewith for setting measurement conditions and analyzing measurement data. Rh is used as an anode of an X-ray tube, the measurement atmosphere is vacuum, the measurement diameter (collimator mask diameter) is 27 mm, and the measurement time is 10 sec. Further, when measuring a light element, the detection is performed with a proportional counter (PC), and when measuring a heavy element, the detection is performed with a scintillation counter (SC).

A pellet obtained by placing 4 g of toner in a dedicated press aluminum ring, flattening, pressing at 20 MPa for 60 sec and molding into a thickness of 2 mm and a diameter of 39 mm by using a tablet compression machine "BRE-32" (manufactured by Maekawa Test Machine Co., Ltd.) is used as a measurement sample.

For example, when the external additive B is a zinc salt of a fatty acid, zinc oxide (ZnO) fine powder is added at 0.1 parts by mass with respect to 100 parts by mass of toner particles including no external additive and sufficiently mixed using a coffee mill. Similarly, silica fine particles are mixed with toner particles at 1.0 part by mass and 5.0 parts by mass, respectively, and these are used as samples for a calibration curve.

For each sample, pellets of the samples for the calibration curve are prepared as described above using the tablet compression machine, and a Zn-Kα ray count rate (unit: cps) observed at the diffraction angle (2θ)=109.08° when PET is used for the dispersive crystal is measured. At this time, the acceleration voltage and the current value of the X-ray generator are set to 24 kV and 100 mA, respectively. A calibration curve of a linear function is obtained by plotting the obtained X-ray count rate against the ordinate and the ZnO addition amount in each calibration curve sample against the abscissa.

Next, the toner to be analyzed is pelletized as described above using the tablet compression machine, and the Zn-Kα ray count rate is measured. Then, the amount of the external additive (fatty acid metal salt) in the toner is determined from the above calibration curve.

Coverage Ratio of External Additive a (Silica Fine Particles)

The coverage ratio of the toner surface with external additives is calculated as follows.

The following device is used under the following conditions, and elemental analysis of the toner surface is performed.

Measuring device: Quantum 2000 (trade name, manufactured by ULVAC-PHI Co., Ltd.)

X-ray source: monochrome Al Kα

X-ray Setting: 100 μmϕ (25 W (15 KV))

Photoelectron take-off angle: 45 degrees

Neutralization condition: neutralizing gun and ion gun used together

Analysis area: 300 μm×200 μm

Pass Energy: 58.70 eV

Step size: 0.125 eV

Analysis software: Multipak (PHI)

For example, the case where the external additive includes silica fine particles is explained hereinbelow. When determining the coverage ratio, quantitative values of Si atoms are calculated using the peaks of C is (B. E. from 280 eV to 295 eV), 0 is (B. E. from 525 eV to 540 eV) and Si 2p (B. E. from 95 eV to 113 eV).

The quantitative value of Si atom obtained here is taken as Y1.

Next, elemental analysis of silica fine particles alone is performed in the same manner as the elemental analysis of the toner surface described above, and the quantitative value of Si atoms obtained herein is taken as Y2.

The coverage ratio X1 of silica fine particles on the toner surface is defined by the following equation using Y1 and Y2 above:

$$X1\ (\%)=(Y1/Y2)\times 100.$$

The measurement is performed 100 times on the same sample, and the arithmetic mean value is adopted.

When obtaining the quantitative value Y2, where an external additive to be used for external addition is available, the measurement may be performed using the external additive.

When the external additive separated from the surface of the toner particle is used as the measurement sample, the external additive is separated from the toner particle by the following procedure.

A total of 160 g of sucrose (manufactured by Kishida Chemical Co., Ltd.) is added to 100 mL of ion-exchanged water and dissolved while heating with a water bath to prepare a concentrated sucrose solution. A total of 31 g of the concentrated sucrose solution and 6 mL of CONTAMINON N are placed in a centrifuge tube to prepare a dispersion liquid. To this dispersion liquid, 1 g of toner is added, and lumps of the toner are loosened with a spatula or the like.

The centrifuge tube is shaken on a shaker ("KM Shaker", manufactured by Iwaki Sangyo Co., Ltd.) for 20 min under the condition of 350 reciprocations per minute. After shaking, the solution is transferred to a glass tube for a swing rotor (50 mL), and centrifugal separation is performed with a centrifuge (H-9R, manufactured by Kokusan Co., Ltd.) under the conditions of 58.33 $S^{-1}$ for 30 min. In the glass tube after centrifugation, the toner is present in the uppermost layer and the external additive is present in the lower layer on the aqueous solution side.

The aqueous solution of the lower layer is collected and centrifuged to separate the sucrose and the external additive B and to collect the external additive. Centrifugation is repeated if necessary, and after sufficient separation, the dispersion liquid is dried and the external additive is collected.

When using a plurality of types of external additives, the target external additive may be selected from the collected external additives by using a centrifugation method or the like.

Measurement Method of Fixation Ratio F of External Additive a (Silica Fine Particles)

A total of 160 g of sucrose (manufactured by Kishida Chemical) is added to 100 mL of ion-exchanged water, and dissolved in a water bath to prepare a concentrated sucrose solution. A total of 31 g of the concentrated sucrose solution and 6 mL of CONTAMINON N (a 10% by mass aqueous solution of a neutral detergent for cleaning precision measuring instruments; has a pH of 7 and includes a nonionic surfactant, an anionic surfactant and an organic builder, manufactured by Wako Pure Chemical Industries, Ltd.) are placed in a tube (capacity 50 mL) for centrifugation to prepare a dispersion liquid. A total of 1.0 g of the toner is added to the dispersion liquid, and the lumps of the toner are loosened with a spatula or the like.

The tube for centrifugation is shaken for 20 min on a shaker ("KMShaker" manufactured by Iwaki Sangyo Co., Ltd.) at a condition of 350 spm (strokes per min). After shaking, the solution is transferred to a glass tube (capacity 50 mL) for a swing rotor, and separated under conditions of 3500 rpm and 30 min in a centrifuge (H-9R; manufactured by Kokusan Co., Ltd.).

It is visually confirmed that the toner and the aqueous solution are sufficiently separated, and the toner separated in the uppermost layer is collected with a spatula or the like.

An aqueous solution including the collected toner is filtered with a vacuum filter, and then dried with a dryer for 1 h or more. The dried product is deagglomerated with a spatula, and the amount of silicon Si elements is measured by X-ray fluorescence. The fixing ratio (%) is calculated from the ratio of the element amounts of the toner treated with the dispersion liquid and the initial toner to be measured.

The measurement of the fluorescent X-rays of each element conforms to JIS K 0119-1969, and is specifically as follows.

As a measuring device, a wavelength dispersive X-ray fluorescence spectrometer "Axios" (manufactured by PANalytical) and dedicated software "SuperQ ver. 4.0F" (manufactured by PANalytical) provided therewith for setting measurement conditions and analyzing measurement data are used. Rh is used as the anode of the X-ray tube, the measurement atmosphere is vacuum, the measurement diameter (collimator mask diameter) is 10 mm, and the measurement time is 10 sec. When a light element is measured, a proportional counter (PC) is used, and when a heavy element is measured, a scintillation counter (SC) is used.

A pellet prepared by placing about 1 g of the toner treated with the dispersion liquid or the initial toner into a dedicated aluminum ring for pressing that has a diameter of 10 mm, flattening, and molding to a thickness of about 2 mm by pressing with a tablet compression machine "BRE-32" (Maekawa Testing Machine MFG Co., Ltd.) at 20 MPa for 60 sec is used as a measurement sample.

The measurement is performed under the above conditions, the elements are identified based on the obtained X-ray peak positions, and the concentration thereof is calculated from the count rate (unit: cps) which is the number of X-ray photons per unit time.

As a quantification method in the toner, for example, the amount of silicon is determined by adding silica ($SiO_2$) fine particles at 0.5 parts by mass with respect to 100 parts by mass of the toner particles and sufficiently mixed using a coffee mill. Similarly, silica fine particles are mixed with the toner particles to obtain 2.0 parts by mass and 5.0 parts by mass, respectively, and these are used as samples for a calibration curve.

For each sample, pellets of the samples for the calibration curve are prepared as described above using the tablet compression machine, and a Si-Kα ray count rate (unit: cps) observed at the diffraction angle (2θ)=109.08° when PET is used for the dispersive crystal is measured. At this time, the acceleration voltage and the current value of the X-ray generator are set to 24 kV and 100 mA, respectively. A calibration curve of a linear function is obtained by plotting the obtained X-ray count rate against the ordinate and the $SiO_2$ addition amount in each calibration curve sample against the abscissa.

Next, the Si-Kα ray count rate is measured using the pellet of the toner to be analyzed. Then, the amount of silicon in the toner is determined from the calibration curve. The ratio of the silicon amount of the toner treated with the dispersion liquid to the initial silicon amount of the toner calculated by the abovementioned method is taken as the fixation ratio (%).

Measurement Method of Fixation Ratio of External Additive B (Fatty Acid Metal Salt)

In the method for measuring the fixation ratio of the external additive A, the element to be measured is the element contained in the fatty acid metal salt. For example, in the case of zinc stearate, zinc is the measurement target. Otherwise, the fixation ratio of the fatty acid metal salt is measured by the same method.

Measurement Method of Number Average Particle Diameter of Primary Particles of External Additive a The number average particle diameter of the primary particles of the external additive A (silica fine particles) is measured using a scanning electron microscope "5-4800" (trade name; manufactured by Hitachi, Ltd.).

The toner to which the external additive has been externally added is observed, and the major axis of 100 randomly selected primary particles of the external additive A is measured in a field of view magnified up to 50000 times to obtain the number average particle diameter. The observation magnification is adjusted, as appropriate, according to the size of the external additive.

The external additive A and the external additive B (fatty acid metal salt) can be distinguished by their appearance with a scanning electron microscope.

Method for Measuring Melting Point of Wax and Glass Transition Temperature Tg of Toner Particle The melting point of the wax and the glass transition temperature Tg of the toner particle are measured using a differential scanning calorimeter "Q1000" (manufactured by TA Instruments) in accordance with ASTM D3418-82. The temperature correction of the device detection unit uses the melting points of indium and zinc, and the heat quantity correction uses the heat of fusion of indium.

Specifically, about 3 mg of a sample (wax, toner particles) is precisely weighed and placed in an aluminum pan, and an empty aluminum pan is used as a reference. The measurement is performed at a temperature rise rate of 10° C./min in a measuring temperature range of from 30° C. to 200° C. In the measurement, the temperature is once raised to 200° C. at a rate of 10° C./min, then lowered to 30° C. at a rate of 10° C./min, and then raised again at a rate of 10° C./min.

Physical properties are determined using the DSC curve obtained in the second temperature increase process. In this DSC curve, the temperature showing a maximum endothermic peak of the DSC curve in the temperature range of from 30° C. to 200° C. is defined as the melting point of the sample. In the DSC curve, the intersection between the line at the midpoint of the baseline before and after the change in specific heat and the DSC curve is defined as the glass transition temperature Tg.

Measurement of Average Circularity of Toner Particles

The average circularity of the toner particle is measured with a "FPIA-3000" flow particle image analyzer (Sysmex Corporation) under the measurement and analysis conditions for calibration operations.

The specific measurement methods are as follows.

About 20 mL of ion-exchange water from which solid impurities and the like have been removed is first placed in a glass container. About 0.2 mL of a dilute solution of "Contaminon N" (a 10 mass % aqueous solution of a pH 7 neutral detergent for washing precision instruments, comprising a nonionic surfactant, an anionic surfactant and an organic builder, manufactured by Wako Pure Chemical Industries, Ltd.) diluted 3-fold by mass with ion-exchange water is then added.

About 0.02 g of the measurement sample is then added and dispersed for 2 minutes with an ultrasonic disperser to obtain a dispersion for measurement. Cooling is performed as appropriate during this process so that the temperature of the dispersion is 10° C. to 40° C.

Using a tabletop ultrasonic cleaner and disperser having an oscillating frequency of 50 kHz and an electrical output of 150 W (for example, "VS-150" manufactured by Velvo-Clear), a specific amount of ion-exchange water is placed on the disperser tank, and about 2 mL of the Contaminon N is added to the tank.

A flow particle image analyzer equipped with a "LUCPLFLN" objective lens (magnification 20×, aperture 0.40) is used for measurement, with particle sheath "PSE-900A" (Sysmex Corporation) as the sheath liquid. The liquid dispersion obtained by the procedures above is introduced into the flow particle image analyzer, and 2000 toner particles are measured in HPF measurement mode, total count mode.

The average circularity of the toner particle is then determined with a binarization threshold of 85% during particle analysis, and with the analyzed particle diameters limited to equivalent circle diameters of at least 1.977 μm to less than 39.54

Prior to the start of measurement, autofocus adjustment is performed using standard latex particles (for example, Duke Scientific Corporation "RESEARCH AND TEST PARTICLES Latex Microsphere Suspensions 5100A" diluted with ion-exchange water). Autofocus adjustment is then performed again every two hours after the start of measurement.

EXAMPLES

The invention is explained in more detail below based on examples and comparative examples, but the invention is in no way limited to these. Unless otherwise specified, parts in the examples are based on mass.

[Production Example of Toner Particles]

Production Example of Toner Particles 1

Toner particle 1 manufacturing examples are explained here.

Preparing Resin Particle Dispersion 89.5 parts of styrene, 9.2 parts of butyl acrylate, 1.3 parts of acrylic acid and 3.2 parts of n-lauryl mercaptane were mixed and dissolved. An aqueous solution of 1.5 parts of Neogen RK (DKS Co., Ltd.) in 150 parts of ion-exchange water was added and dispersed. This was then gently stirred for 10 minutes as an aqueous solution of 0.3 parts of potassium persfulate in 10 parts of ion-exchange water was added. After nitrogen purging, emulsion polymerization was performed for 6 hours at 70° C. After completion of polymerization, the reaction solution was cooled to room temperature, and ion-exchange water was added to obtain a resin particle dispersion with a median volume-based particle diameter of 0.2 μm and a solids concentration of 12.5 mass %.

Preparing Release Agent Dispersion 100 parts of a release agent (behenyl behenate, melting point 72.1° C.) and 15 parts of Neogen RK were mixed with 385 parts of ion-exchange water, and dispersed for about 1 hour with a wet type jet mill unit JN100 (Jokoh Co., Ltd.) to obtain a release agent dispersion. The solids concentration of the release agent dispersion was 20 mass %.

Preparation of Colorant Dispersion 100 parts of carbon black as a colorant "Nipex35 (Orion Engineered Carbons)" and 15 parts of Neogen RK were mixed with 885 parts of ion-exchange water, and dispersed for about 1 hour in a wet type jet mill unit JN100 to obtain a colorant dispersion.

Preparation of Toner Particles 1

265 parts of the resin particle dispersion, 10 parts of the release agent dispersion and 10 parts of the colorant dispersion were dispersed with a homogenizer (Ultra-Turrax T50, IKA). The temperature inside the vessel was adjusted to 30° C. under stirring, and 1 mol/L hydrochloric acid was added to adjust the pH to 5.0. This was left for 3 minutes before initiating temperature rise, and the temperature was raised to 50° C. to produce aggregate particles.

The particle diameter of the aggregate particles was measured under these conditions with a "Multisizer (R) 3 Coulter Counter" (Beckman Coulter, Inc.). Once the weight-average particle diameter reached 6.2 μm, 1 mol/L sodium hydroxide aqueous solution was added to adjust the pH to 8.0 and arrest particle growth.

The temperature was then raised to 95° C. to fuse and spheroidize the aggregate particles. Temperature lowering was initiated when the average circularity reached 0.980, and the temperature was lowered to 30° C. to obtain a toner particle dispersion 1.

Hydrochloric acid was added to adjust the pH of the resulting toner particle dispersion 1 to 1.5 or less, and the dispersion was stirred for 1 hour, left standing, and then subjected to solid-liquid separation in a pressure filter to obtain a toner cake. This was made into a slurry with ion-exchange water, re-dispersed, and subjected to solid-liquid separation in the previous filter unit. Re-slurrying and solid-liquid separation were repeated until the electrical conductivity of the filtrate was not more than 5.0 gS/cm, to ultimately obtain a solid-liquid separated toner cake.

The resulting toner cake was dried with a flash jet dryer (air dryer) (Seishin Enterprise Co., Ltd.). The drying conditions were a blowing temperature of 90° C. and a dryer outlet temperature of 40° C., with the toner cake supply speed adjusted according to the moisture content of the toner cake so that the outlet temperature did not deviate from 40° C. Fine and coarse powder was cut with a multi-division classifier using the Coanda effect, to obtain a toner particle 1. Table 1 shows various physical properties.

Production Example of Toner Particles 2

Toner particles 2 were obtained in the same manner as in the Production Example of Toner Particles 1 except that the particle growth stopping timing in the generation step of the aggregate particles in the production example of the toner particles 1 is changed. Table 1 shows various physical properties.

TABLE 1

| | Number average particle diameter (μm) | Theoretical average surface area C ($m^2/g$) | Average circularity | Tg (° C.) |
|---|---|---|---|---|
| Toner particle 1 | 5.5 | 1.0 | 0.980 | 57 |
| Toner particle 2 | 4.5 | 1.2 | 0.980 | 57 |

[Production Example of Fatty Acid Metal Salt]

Production of Fatty Acid Metal Salt 1

A receiving container equipped with a stirrer was prepared, and the stirrer was rotated at 350 rpm. 500 parts of an 0.5 mass % aqueous solution of sodium stearate were placed in the receiving container, and the liquid temperature was adjusted to 85° C. 525 parts of an 0.2 mass % zinc sulfate aqueous solution were then dripped into the receiving container over the course of 15 minutes. After completion of all additions, this was cured for 10 minutes at the same temperature as the reaction, and the reaction was ended.

The fatty acid metal salt slurry thus obtained was filtered and washed. The resulting washed fatty acid metal salt cake was crushed, and dried at 105° C. with a continuous instantaneous air dryer. This was then pulverized with a Nano Grinding Mill NJ-300 (Sunrex Industry Co., Ltd.) with an air flow of 6.0 $m^3$/min at a processing speed of 80 kg/h. This was re-slurried, and fine and coarse particles were removed with a wet centrifuge. This was then dried at 80° C. with a continuous instantaneous air drier to obtain a dried fatty acid metal salt 1.

The resulting fatty acid metal salt 1 had a volume-based median diameter (D50s) of 0.45 μm and a span value B of 0.92. Table 2 shows the physical properties of the fatty acid metal salt 1.

Production of Fatty Acid Metal Salt 2

In the Production of Fatty Acid Metal Salt 1, the 0.5% by mass aqueous solution of sodium stearate was replaced with a 1.0% by mass aqueous solution of sodium stearate, and the 0.2% by mass aqueous solution of zinc sulfate was replaced with 0.7% by mass aqueous solution of calcium chloride. The reaction was terminated by 5-min aging. Further, the pulverization conditions were changed to an air volume of 5.0 $m^3$/min, and after the pulverization, fine and coarse powders were removed with a wind-type classifier to obtain fatty acid metal salt 2.

The resulting fatty acid metal salt 2 had a volume-based median diameter (D50s) of 0.58 μm and a span value B of 1.73. Table 2 shows the physical properties of the fatty acid metal salt 2.

Production of Fatty Acid Metal Salt 3

Fatty acid metal salt 3 were obtained in the same manner as in the Production of Fatty Acid Metal Salt 1, except that the 0.2% by mass aqueous solution of zinc sulfate was replaced with a 0.3% by mass aqueous solution of lithium chloride.

The resulting fatty acid metal salt 3 had a volume-based median diameter (D50s) of 0.33 μm and a span value B of 0.85. Table 2 shows the physical properties of the fatty acid metal salt 3.

Production of Fatty Acid Metal Salt 4

A fatty acid metal salt 4 was obtained in the same manner as in the Production of Fatty Acid Metal Salt 1, except that the 0.5% by mass aqueous solution of sodium stearate was replaced with a 0.5% by mass aqueous solution of sodium laurate.

The volume-based median diameter (D50s) of the obtained fatty acid metal salt 4 was 0.62 μm, and the span value B was 1.05. Table 2 shows the physical properties of the fatty acid metal salt 4.

Production of Fatty Acid Metal Salt 5

A fatty acid metal salt 5 was obtained in the same manner as in the Production of Fatty Acid Metal Salt 1, except that the 0.5% by mass aqueous solution of sodium stearate was replaced with a 0.25% by mass aqueous solution of sodium stearate, the 0.2% by mass aqueous solution of zinc sulfate was replaced with a 0.15% by mass aqueous solution of zinc sulfate, the pulverization condition was changed to an air flow rate of 10.0 $m^3$/min, and the number of pulverization steps was changed to three.

The volume-based median diameter (D50s) of the obtained fatty acid metal salt 5 was 0.18 μm, and the span value B was 1.34. Table 2 shows the physical properties of the fatty acid metal salt 5.

Fatty Acid Metal Salt 6

Commercially available zinc stearate (MZ2, manufactured by NOF Corporation) was used as the fatty acid metal salt 6. The volume-based median diameter (D50s) was 1.29 μm, and the span value B was 1.61. Table 2 shows the physical properties of the fatty acid metal salt 6.

Fatty Acid Metal Salt 7

Commercially available zinc stearate (SZ2000, manufactured by Sakai Chemical Industry Co., Ltd.) was used as the fatty acid metal salt 7. The volume-based median diameter (D50s) was 5.30 μm, and the span value B was 1.84. Table 2 shows the physical properties of the fatty acid metal salt 7.

TABLE 2

| | Type | Number of carbon atoms in fatty acid | D50s (μm) | Span value B |
|---|---|---|---|---|
| Fatty acid metal salt 1 | Zinc stearate | 18 | 0.45 | 0.92 |
| Fatty acid metal salt 2 | Calcium stearate | 18 | 0.58 | 1.73 |
| Fatty acid metal salt 3 | Lithium stearate | 18 | 0.33 | 0.85 |
| Fatty acid metal salt 4 | Zinc laurate | 12 | 0.62 | 1.05 |
| Fatty acid metal salt 5 | Zinc stearate | 18 | 0.18 | 1.34 |

TABLE 2-continued

| | Type | Number of carbon atoms in fatty acid | D50s (μm) | Span value B |
|---|---|---|---|---|
| Fatty acid metal salt 6 | Zinc stearate | 18 | 1.29 | 1.61 |
| Fatty acid metal salt 7 | Zinc stearate | 18 | 5.3 | 1.84 |

Silica Fine Particles

The following silica particles were used.

Silica Fine Particles 1

A total of 100 parts of dry silica fine powder [BET specific surface area 300 $m^2$/g] was hydrophobized with 25 parts of dimethyl silicone oil.

Silica Fine Particles 2

A total of 100 parts of dry silica fine powder [BET specific surface area 150 $m^2$/g] was hydrophobized with 20 parts of dimethyl silicone oil.

Silica Fine Particles 3

A total of 100 parts of dry silica fine powder [BET specific surface area 90 $m^2$/g] was hydrophobized with 2 parts of hexamethyldisilazane (HMDS) and 10 parts of dimethyl silicone oil.

Silica Fine Particles 4

A total of 100 parts of dry silica fine powder [BET specific surface area 50 $m^2$/g] was hydrophobized with 1.2 parts of hexamethyldisilazane (HMDS).

Production Example of Toner 1

First, as a mixing step 1, the toner particles 1 and the silica fine particles 2 were mixed using an FM mixer (FM10C type, manufactured by Nippon Coke Industry Co., Ltd.).

With the water temperature inside the FM mixer jacket stabilized at 40° C.±1° C., 100 parts of the toner particles 1 and 2.0 parts of the silica fine particles 2 were added. Mixing was started at a peripheral speed of the rotating blades of 38 m/sec, and mixing was performed for 10 min while controlling the water temperature and flow rate in the jacket so that the tank temperature was stable at 40° C.±1° C. to obtain a mixture of the toner particles 1 and the silica fine particles 2.

Subsequently, in the mixing step 2, the fatty acid metal salt 1 was added to the mixture of the toner particles 1 and the silica fine particles 2 by using an FM mixer (FM10C type, manufactured by Nippon Coke Industry Co., Ltd.). With the water temperature in the jacket of the FM mixer stabilized at 25° C.±1° C., 0.2 parts of the fatty acid metal salt 1 was added to 100 parts of the toner particles 1.

Mixing was started at the peripheral speed of the rotating blades of 20 m/sec, mixing was performed for 5 min while controlling the water temperature and flow rate in the jacket so that the temperature inside the tank was stable at 25° C.±1° C., and then sieving was performed with a mesh having openings of 75 μm to obtain a toner 1. Table 3 shows the manufacturing conditions of the toner 1, and Table 4 shows the physical properties thereof.

TABLE 3

| | | Mixing step 1 | | | | | | Mixing step 2 | | | | | | |
|---|---|---|---|---|---|---|---|---|---|---|---|---|---|---|
| | | External additive A | | External additive B | | | | External additive A | | | External additive B | | Mixing | |
| Toner No. | Toner particle No. | silica fine particles No. | parts | fatty acid metal salt No. | parts | Mixing conditions with FM mixer | T. (° C.) | silica fine particles No. | parts | Hydrotalcite compound (parts) | fatty acid metal salt No. | parts | conditions with FM mixer | T. (° C.) |
| 1 | 1 | 2 | 2.0 | — | — | 38 m/s 10 min | 40 | — | — | — | 1 | 0.2 | 20 m/s 5 min | 25 |
| 2 | 1 | 1 | 2.5 | — | — | 38 m/s 10 min | 25 | — | — | — | 1 | 0.2 | 20 m/s 5 min | 25 |
| 3 | 1 | 3 | 2.3 | — | — | 38 m/s 10 min | 45 | — | — | — | 1 | 0.2 | 20 m/s 5 min | 25 |
| 4 | 1 | 1 | 2.0 | — | — | 38 m/s 10 min | 25 | — | — | — | 1 | 0.2 | 20 m/s 5 min | 25 |
| 5 | 1 | 1 | 3.0 | — | — | 38 m/s 10 min | 25 | — | — | — | 1 | 0.2 | 20 m/s 5 min | 25 |
| 6 | 2 | 1 | 2.5 | — | — | 38 m/s 10 min | 25 | — | — | — | 1 | 1.9 | 20 m/s 5 min | 25 |
| 7 | 1 | 1 | 2.5 | — | — | 38 m/s 10 min | 25 | — | — | — | 1 | 0.05 | 20 m/s 5 min | 25 |
| 8 | 1 | 1 | 2.5 | — | — | 38 m/s 10 min | 25 | — | — | — | 1 | 0.2 | 20 m/s 8 min | 25 |
| 9 | 1 | 2 | 2.0 | — | — | 38 m/s 10 min | 25 | — | — | — | 1 | 0.2 | 20 m/s 5 min | 25 |
| 10 | 2 | 1 | 2.5 | — | — | 38 m/s 10 min | 25 | — | — | — | 1 | 1.9 | 28 m/s 8 min | 25 |
| 11 | 1 | 1 | 2.5 | — | — | 38 m/s 10 min | 25 | — | — | — | 2 | 0.2 | 20 m/s 5 min | 25 |
| 12 | 1 | 1 | 2.5 | — | — | 38 m/s 10 min | 25 | — | — | — | 3 | 0.2 | 20 m/s 5 min | 25 |
| 13 | 1 | 1 | 2.5 | — | — | 38 m/s 10 min | 25 | — | — | — | 4 | 0.2 | 20 m/s 5 min | 25 |
| 14 | 1 | 1 | 2.5 | — | — | 38 m/s 10 min | 25 | — | — | — | 5 | 0.2 | 20 m/s 5 min | 25 |
| 15 | 1 | 1 | 2.5 | — | — | 38 m/s 10 min | 25 | — | — | — | 6 | 0.2 | 20 m/s 5 min | 25 |
| 16 | 1 | 1 | 2.5 | — | — | 38 m/s 10 min | 25 | — | — | 0.2 | 1 | 0.2 | 20 m/s 5 min | 25 |
| 17 | 1 | 3 | 2.5 | — | — | 38 m/s 10 min | 25 | — | — | — | 1 | 1.9 | 20 m/s 5 min | 25 |
| 18 | 1 | 1 | 2.5 | — | — | 38 m/s 10 min | 25 | — | — | — | 7 | 0.2 | 20 m/s 5 min | 25 |
| C. 1 | 1 | 4 | 2.4 | — | — | 38 m/s 10 min | 45 | — | — | — | 1 | 0.2 | 20 m/s 5 min | 25 |
| C. 2 | 1 | 1 | 1.5 | — | — | 38 m/s 10 min | 25 | — | — | — | 1 | 0.2 | 20 m/s 5 min | 25 |
| C. 3 | 1 | 1 | 2.5 | — | — | 38 m/s 10 min | 25 | — | — | — | 1 | 0.04 | 20 m/s 5 min | 25 |
| C. 4 | 2 | 1 | 2.5 | — | — | 38 m/s 10 min | 25 | — | — | — | 1 | 2.5 | 20 m/s 5 min | 25 |
| C. 5 | 1 | 1 | 2.5 | — | — | 38 m/s 10 min | 25 | — | — | — | 1 | 0.2 | 30 m/s 10 min | 25 |
| C. 6 | 1 | 1 | 2.5 | 1 | 0.2 | 38 m/s 10 min | 25 | — | — | — | 1 | — | — | 25 |

In the table, "C." denotes "Comparative", and "T." denotes "Temperature".

Production Examples of Toners 2 to 18 and Comparative Toners 1 to 6

Toners 2 to 18 and comparative toners 1 to 6 were obtained in the same manner as in the Production Example of Toner 1, except that the toner particles, materials added and the number of addition parts in the mixing step 1 and the mixing step 2, and the mixing conditions in the Production Example of Toner 1 were changed as shown in Table 3.

In the toner 16, 0.2 parts of a hydrotalcite compound (DHT-4A, manufactured by Kyowa Chemical Industry Co., Ltd.) was used with respect to 100 parts of the toner particles. Table 4 shows the physical properties.

TABLE 4

| Toner No. | 1 | 2 | 3 | 4 | 5 | 6 | 7 | 8 | 9 | 10 | 11 | 12 |
|---|---|---|---|---|---|---|---|---|---|---|---|---|
| External additive A: particle diameter (nm) | 15 | 7 | 23 | 7 | 7 | 7 | 7 | 7 | 15 | 7 | 7 | 7 |
| External additive A, coverage ratio (%) | 72 | 68 | 62 | 61 | 75 | 63 | 69 | 68 | 72 | 60 | 61 | 61 |
| C: Average theoretical surface area (m/g) | 1.0 | 1.0 | 1.0 | 1.0 | 1.0 | 1.2 | 1.0 | 1.0 | 1.0 | 1.2 | 1.0 | 1.0 |
| D: Amount D of external additive B (parts) | 0.2 | 0.2 | 0.2 | 0.2 | 0.2 | 1.9 | 0.05 | 0.2 | 0.2 | 1.9 | 0.2 | 0.2 |
| E: External additive B, coverage ratio (%) | 6.2 | 8.0 | 5.3 | 4.0 | 10.0 | 35.2 | 0.7 | 9.7 | 6.4 | 40.6 | 5.1 | 6.2 |
| D/C | 0.20 | 0.20 | 0.20 | 0.20 | 0.20 | 1.58 | 0.05 | 0.20 | 0.20 | 1.58 | 0.20 | 0.20 |
| E/(D/C) | 31.0 | 40.0 | 26.5 | 20.0 | 50.0 | 22.2 | 14.4 | 48.5 | 32.0 | 25.6 | 25.5 | 31.0 |
| Fixation ratio F (%) | 80.0 | 88.0 | 75.0 | 78.0 | 90.0 | 84.0 | 89.0 | 86.0 | 75.0 | 83.0 | 77.0 | 76.0 |
| Fixation ratio G (%) | 1.4 | 2.0 | 1.3 | 1.5 | 3.2 | 8.0 | 0.8 | 5.3 | 2.2 | 11.0 | 1.5 | 2.5 |
| F/G | 57.1 | 44.0 | 57.7 | 52.0 | 28.1 | 10.5 | 111.3 | 16.2 | 34.1 | 7.5 | 51.3 | 30.4 |

| Toner No. | 13 | 14 | 15 | 16 | 17 | 18 | C. 1 | C. 2 | C. 3 | C. 4 | C. 5 | C. 6 |
|---|---|---|---|---|---|---|---|---|---|---|---|---|
| External additive A particle diameter (nm) | 7 | 7 | 7 | 7 | 23 | 7 | 30 | 7 | 7 | 7 | 7 | 7 |
| External additive A, coverage ratio (%) | 60 | 66 | 69 | 68 | 62 | 68 | 60 | 56 | 69 | 63 | 75 | 68 |
| C: Average theoretical surface area ($m^2$/g) | 1.0 | 1.0 | 1.0 | 1.0 | 1.0 | 1.0 | 1.0 | 1.0 | 1.0 | 1.2 | 1.0 | 1.0 |
| D: Amount D of external additive B (parts) | 0.2 | 0.2 | 0.2 | 0.2 | 1.9 | 0.2 | 0.2 | 0.2 | 0.04 | 2.5 | 0.2 | 0.2 |
| E: External additive B, coverage ratio (%) | 9.8 | 9.8 | 5.0 | 7.2 | 37.0 | 7.0 | 4.1 | 3.5 | 0.7 | 42.0 | 12.0 | 14.0 |
| D/C | 0.20 | 0.20 | 0.20 | 0.20 | 1.90 | 0.20 | 0.20 | 0.20 | 0.04 | 2.08 | 0.20 | 0.20 |
| E/(D/C) | 49.0 | 49.0 | 25.0 | 36.0 | 19.5 | 35.0 | 20.5 | 17.5 | 18.0 | 20.2 | 60.0 | 70.0 |

TABLE 4-continued

| | | | | | | | | | | | | |
|---|---|---|---|---|---|---|---|---|---|---|---|---|
| Fixation ratio F (%) | 74.0 | 86.0 | 89.0 | 87.0 | 73.0 | 88.0 | 71.0 | 70.0 | 89.0 | 80.0 | 90.0 | 85.0 |
| Fixation ratio G (%) | 0.5 | 0.9 | 6.0 | 2.5 | 9.8 | 1.2 | 1.0 | 2.0 | 0.7 | 12.0 | 3.2 | 15.0 |
| F/G | 148.0 | 95.6 | 14.8 | 34.8 | 7.4 | 73.3 | 71.0 | 35.0 | 127.1 | 6.7 | 28.1 | 5.7 |

In the table, "particle diameter" indicates number average particle diameter of primary particles, and "C." denotes "Comparative".

Examples 1 to 18, Comparative Examples 1 to 6

The obtained toners 1 to 18 and comparative toners 1 to 6 were evaluated by evaluation methods described below. Table 5 shows the evaluation results.

Evaluation with LBP

A modified version of the commercially available Canon laser beam printer LBP9950Ci was used. The modification involved changing the process speed to 330 mm/sec by changing the gear and software of the evaluation machine body, and also enabling printing only with the black station. The toner contained in the process cartridge of LBP9950Ci was taken out, the inside was cleaned by air blow, and 150 g of toner to be evaluated was loaded.

Then, the process cartridge was allowed to stand for 24 h in an environment NN of normal temperature and normal humidity (25° C./50% RH). The process cartridge after standing was attached to the LBP9950Ci black station. In the normal-temperature and normal-humidity environment NN (25° C./50% RH), an image with a print percentage of 1.0% was printed out up to 10000 prints in the lateral direction of A4 paper.

After printing 10000 prints, the following evaluations were performed.

Evaluation of Cleaning Property

Five halftone images with a toner laid-on level of 0.2 mg/cm$^2$ were printed and visually evaluated according to the following criteria. C or higher was determined to be satisfactory.

A: no cleaning defects, no charging roller contamination.

B: no cleaning defects, contamination on charging roller.

C: some cleaning defects can be confirmed on the halftone image.

D: cleaning failure is noticeable on the halftone image.

Evaluation of Retransferability

A black toner-free cartridge was set in the black station, and a cartridge after outputting 10000 images was set in the cyan station. Then, the developing voltage was adjusted so that the toner laid-on level on the photosensitive member was 0.60 mg/cm$^2$, and a solid image was outputted. Then, the toner retransferred to the photosensitive member of the black station cartridge was taped with a Mylar tape and peeled off.

The difference in reflectance was calculated by subtracting the reflectance T0 of the clean tape attached to the XEROX 4200 paper (75 g/m$^2$ manufactured by XEROX) from the reflectance T1 of the peeled-off tape attached to the paper. The following determination was made from the value of the reflectance difference. The reflectance was measured using REFLECTMETER MODEL TC-6DS manufactured by Tokyo Denshoku Co., Ltd. The smaller the value, the more the retransfer is prevented. C or higher was determined to be satisfactory.

Evaluation Criteria

A: difference in reflectance is 2.0% or less.

B: difference in reflectance is more than 2.0% and 5.0% or less.

C: difference in reflectance is more than 5.0% and 10.0% or less.

D: difference in reflectance is more than 10.0%.

Evaluation of Development Streaks

The number of vertical streaks that appeared on the developing roller after the 10000 images were printed was evaluated according to the following criteria. C or higher was determined to be satisfactory.

Evaluation Criteria

A: no vertical streak is seen on the developing roller.

B: not more than 3 thin streaks in the circumferential direction are seen on both ends of the developing roller.

C: from 4 to 10 thin streaks in the circumferential direction are seen on both ends of the developing roller.

D: not less than 11 streaks are seen on the developing roller.

Evaluation of Fogging

After outputting the above 10000 images, one solid white image was outputted, and the obtained solid white image was evaluated for fogging. The fogging density (%) was measured using "REFLECTMETER MODEL TC-6DS" (manufactured by Tokyo Denshoku Co., Ltd.) and calculating the fogging density (%) from the difference between the whiteness of the white background portion of the measured image and the whiteness of the transfer paper.

A green filter was used. C or higher was determined to be satisfactory.

Evaluation Criteria

A: fogging density is less than 0.5%.

B: fogging density is 0.5% or more and less than 1.0%.

C: fogging density is 1.0% or more and less than 2.0%.

D: fogging density is 2.0% or more

TABLE 5

| | Toner | Cleaning property | Retrans-ferability | Fogging | Develop-ment streaks |
|---|---|---|---|---|---|
| Example 1 | Toner 1 | A | A | B | A |
| Example 2 | Toner 2 | A | A | B | A |
| Example 3 | Toner 3 | A | C | B | A |
| Example 4 | Toner 4 | A | C | B | A |
| Example 5 | Toner 5 | A | A | A | A |
| Example 6 | Toner 6 | A | B | C | C |
| Example 7 | Toner 7 | C | A | A | A |
| Example 8 | Toner 8 | A | B | B | A |
| Example 9 | Toner 9 | A | C | B | A |
| Example 10 | Toner 10 | A | C | B | C |
| Example 11 | Toner 11 | A | B | B | A |
| Example 12 | Toner 12 | B | C | B | A |
| Example 13 | Toner 13 | B | C | B | A |
| Example 14 | Toner 14 | A | A | B | A |
| Example 15 | Toner 15 | A | A | B | B |
| Example 16 | Toner 16 | A | A | A | A |
| Example 17 | Toner 17 | A | C | B | B |
| Example 18 | Toner 18 | C | B | B | C |
| Comparative Example 1 | Comparative toner 1 | A | D | C | A |
| Comparative Example 2 | Comparative toner 2 | A | D | C | A |

TABLE 5-continued

| | Toner | Cleaning property | Retrans-ferability | Fogging | Develop-ment streaks |
|---|---|---|---|---|---|
| Comparative Example 3 | Comparative toner 3 | D | B | B | A |
| Comparative Example 4 | Comparative toner 4 | A | D | D | D |
| Comparative Example 5 | Comparative toner 5 | B | D | C | A |
| Comparative Example 6 | Comparative toner 6 | C | D | D | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-123922, filed Jul. 2, 2019, which is hereby incorporated by reference herein in its entirety.

What is claimed is:

1. A toner, comprising:

a toner particle including a binder resin; and an external additive, said external additive including an external additive A and an external additive B, the external additive A comprising silica fine particles having primary particles with a number average particle diameter of 5 to 25 nm, a surface of the toner particle having a coverage ratio with external additive A of 60 to 80%, the external additive B comprising a fatty acid metal salt, wherein $$0.05 \leq D/C \leq 2.00 \text{ and } E/(D/C) \leq 50.0$$

where C ($m^2/g$) is an average theoretical surface area obtained from a number average particle diameter, a particle size distribution and a true density of the toner particle measured by a Coulter counter, D (parts by mass) is an amount of the external additive B with respect to 100 parts by mass of the toner particle and E (%) is a coverage ratio of the surface of the toner particle with external additive B, and $$F/G \geq 8.0$$

where F (%) is a fixation ratio of external additive A to the toner particle and G (%) is a fixation ratio of external additive B to the toner particle.

2. The toner according to claim 1, wherein F is 80% or more.

3. The toner according to claim 1, wherein G is 10% or less.

4. The toner according to claim 1, wherein the fatty acid metal salt comprises at least one of zinc stearate or calcium stearate.

5. The toner according to claim 1, wherein the fatty acid metal salt has a volume-based median diameter of 0.15 to 2.00 μm.

6. The toner according to claim 1, wherein the external additive further includes a hydrotalcite compound.

7. A toner, comprising:

a toner particle including a binder resin; and an external additive, said external additive including an external additive A and an external additive B, the external additive A comprising silica fine particles having primary particles with a number average particle diameter of 5 to 25 nm, a surface of the toner particle having a coverage ratio with external additive A of 60 to 80%, the external additive B comprising a fatty acid metal salt, wherein $$0.05 \leq D/C \leq 2.00 \text{ and } E/(D/C) \leq 50.0$$

where C ($m^2/g$) is an average theoretical surface area obtained from a number average particle diameter, a particle size distribution and a true density of the toner particle measured by a Coulter counter, D (parts by mass) is an amount of the external additive B with respect to 100 parts by mass of the toner particle and E (%) is a coverage ratio of the surface of the toner particle with external additive B, and a span value B of the fatty acid metal salt defined by (D95s−D5s)/D50s is 1.75 or less where D5s, D50s and D95s are respectively volume-based 5, 50 and 95% cumulative diameters of the fatty acid metal salt.

* * * * *